US006886681B2

(12) United States Patent
Nolan et al.

(10) Patent No.: US 6,886,681 B2
(45) Date of Patent: May 3, 2005

(54) CONVEYOR FOR INVERTING WEB OF MATERIAL

(75) Inventors: Benjamin Nolan, Elmer, NJ (US); Leonard Streeper, Richland, NJ (US)

(73) Assignee: Polymer Group, Inc., Charleston, SC (US)

( * ) Notice: Subject to any disclaimer, the term of this patent is extended or adjusted under 35 U.S.C. 154(b) by 47 days.

(21) Appl. No.: 10/438,490

(22) Filed: May 15, 2003

(65) Prior Publication Data

US 2004/0020962 A1 Feb. 5, 2004

Related U.S. Application Data

(60) Provisional application No. 60/381,960, filed on May 17, 2002.

(51) Int. Cl.[7] ..... B65G 15/00

(52) U.S. Cl. ..... 198/405; 198/408; 198/689.1; 198/839

(58) Field of Search ..... 198/405, 408, 198/839, 689.1

(56) References Cited

U.S. PATENT DOCUMENTS

| | | | | |
|---|---|---|---|---|
| 3,273,886 A | | 9/1966 | Taylor, Jr. | |
| 3,464,690 A | | 9/1969 | Wilde et al. | |
| 3,789,973 A | | 2/1974 | Kugler | |
| 4,453,841 A | | 6/1984 | Bobick et al. | |
| 4,604,851 A | | 8/1986 | Reist | |
| 4,620,552 A | * | 11/1986 | Hinzmann | 131/84.3 |
| 4,986,416 A | * | 1/1991 | Arthurs | 206/170 |
| 5,083,657 A | * | 1/1992 | Kelsey | 198/811 |
| 5,114,307 A | * | 5/1992 | Meli et al. | 414/793.1 |
| 5,520,824 A | * | 5/1996 | Sasaki | 210/780 |
| 5,600,906 A | * | 2/1997 | Hamid | 38/143 |
| 5,743,379 A | * | 4/1998 | Warnecke | 198/839 |
| 6,227,541 B1 | * | 5/2001 | Couillard et al. | 271/307 |
| 6,446,789 B1 | * | 9/2002 | Goodman | 198/689.1 |
| 6,662,937 B2 | * | 12/2003 | Warnecke | 198/831 |
| 6,685,010 B2 | * | 2/2004 | Warnecke | 198/814 |

* cited by examiner

*Primary Examiner*—Douglas Hess
(74) *Attorney, Agent, or Firm*—Wood, Phillips, Katz, Clark & Mortimer

(57) ABSTRACT

The present invention relates to a conveyor apparatus, and more specifically to a conveyor apparatus that is capable of accepting a web of material having little to no inherent structural integrity from a first direction, inverting the material, and dispatching said material in a second direction. A conveyor apparatus for handling and inverting a web of material in accordance with the present invention comprises a receiving conveyor having an upper run for receiving the web of material after inversion. The present apparatus further includes an inversion conveyor having first and second legs arranged at an angle to each other, with the second leg of the conversion conveyor being positioned above the upper run of the receiving conveyor.

6 Claims, 2 Drawing Sheets

CONVEYOR FOR INVERTING WEB OF MATERIAL

This application claims benefit of 60/381,960 filed May 17, 2002.

TECHNICAL FIELD

The present invention relates to a conveyor apparatus and, more specifically, to a conveyor apparatus that is capable of accepting a web of material having little to no inherent structural integrity, from a first direction, inverting said material, and dispatching said material in a second direction.

BACKGROUND OF THE INVENTION

Conveyor belts generally take the form of endless belts passing over rollers amounted on stands. Such conveyor systems are usually constructed of flexible sheet stock of generally metallic, polymeric rubber, or fabric form. For products susceptible to contact damage, such as electronic components, food items, and fibrous products, it is necessary that the conveyor belt has an even supporting surface, while at the same time the supporting surface may also be required to have a foraminous or porous quality, so as to enable air to pass transversely of the plane of the conveyor belt to enable retention of the product. The conventional endless belt conveyor assembly traditionally moves in an essentially rectilinear path, however, for many manufacturing operations, it is advantageous to have a conveyor system that turns or bends during its course of travel.

There remains a need for a conveyor apparatus that is capable of transporting a material, which exhibits little to no inherent structural integrity, along in a first direction, inverting the material, and dispatching the material to a second direction.

One particular embodiment of the present invention relates to nonwoven fabrics, whereby the product involves a manufacturing step, in which a low integrity fibrous ban is required. The fibrous matt may then be incorporated into a composite or laminate nonwoven fabric structure.

Composite or laminate nonwoven fabrics, hereinafter referred to as "compound" fabrics, are used in a variety of applications, such as cleaning wipes and backsheets for diapers. During the production of such multi-layered, compound fabrics, it is sometimes necessary to utilize multiple pieces of large, complex, and expensive equipment such as cards and film extrudes. For example, the production of multi-layered film can require more than one extruder and either a co-extrusion feedblock or multi-manifold die system or combination of the two. However, by utilizing a conveyor belt, these compound nonwoven fabric production line assets, such as a spunbond line, can be better utilized to feed multiple production lines, or to create layered or complex constructs from fewer pieces of equipment.

The conveyor apparatus of the present invention fulfills a need to manipulate the course of a fibrous batt whereby the batt is inverted without disrupting the fiber alignment of the fibrous batt. The incorporation of a conveyor apparatus into the production of a composite nonwoven fabric would cut down on the production expense due to the ability to eliminate one or more large pieces of manufacturing equipment from the production path.

SUMMARY OF THE INVENTION

The present invention relates to a conveyor apparatus, and more specifically to a conveyor apparatus that is capable of accepting a web of material having little to no inherent structural integrity from a first direction, inverting the material, and dispatching said material in a second direction.

A conveyor apparatus for handling and inverting a web of material in accordance with the present invention comprises a receiving conveyor having an upper run for receiving the web of material after inversion. The present apparatus further includes an inversion conveyor having first and second legs arranged at an angle to each other, with the second leg of the conversion conveyor being positioned above the upper run of the receiving conveyor.

The inversion conveyor comprises a first conveyor roller positioned at one end of the first leg, and a second conveyor roller positioned at one end of the second leg. One or both of the first and second rollers may be suitably driven for driving the inversion conveyor.

The inversion conveyor further includes first and second, generally parallel conveyor guides which are positioned at an angle to each of the first and second rollers, at the juncture of the first and second legs of the inversion conveyor.

The inversion conveyor further comprises an inversion conveyor belt. The inversion conveyor belt extends continuously around both of the first and second rollers, as well as the first and second guides in accordance with the following configuration:

1. Along an upper run of the first leg from above the first roller to beneath the first conveyor guide;
2. Along a lower run of the second leg from beneath the first conveyor guide to beneath the second roller, above the upper surface of the receiving conveyor;
3. Along an upper run of said second leg from above said second roller to beneath said second guide; and
4. Along a lower run of the first leg from beneath the second guide to said first roller.

By the above-described configuration, when the web of material is received on the upper run of the first leg of the inversion conveyor, the web of material is inverted as the web moves around and beneath the first guide, with the inverted web of material received on the upper run of the receiving conveyor.

In one illustrated embodiment, the first and second conveyor guides are provided in the form of a pair of cylindrical guides of the same diameter mounted in generally parallel relationship. In an alternate embodiment, the first and second guides respectively define first and second concentric guide surfaces, with the second guide surface positioned generally within the first guide surface.

The turning conveyor can be used to redirect either a constant or intermittent supply of material from a first direction to a second direction. The first and second directions can be of the same direction, or deviate by an angle of as much as 180°. The turning conveyor can also be utilized to form a layer upon a pre-existing layer carried by the receiving conveyor. The turning conveyor is able to deliver said first substrate to said second substrate without disrupting the integrity of the first substrate.

It is within the purview of the present invention that a retention means can be incorporated into the turning conveyor assembly so as to restrain the material during the inversion and re-direction. Suitable retention means included those selected from the group consisting of mechanical, electrostatic, magnetic attraction and the combinations thereof. A particularly preferred mechanical retentive means includes the use of a vacuum source. The vacuum, or other retentive means, may be either positioned to effect the entire track of the turning conveyor, or be positioned along one or more of the axis, or paths, for which the conveyor turns, in order to gently confine the material to the belt during its course of travel.

DETAILED DESCRIPTION OF THE INVENTION

While the present invention is susceptible of embodiment in various forms, hereinafter is described a presently preferred embodiment of the invention, with the understanding that the present disclosure is to be considered as an exemplification of the invention, and is not intended to limit the invention to the specific embodiment illustrated.

Figure 1:
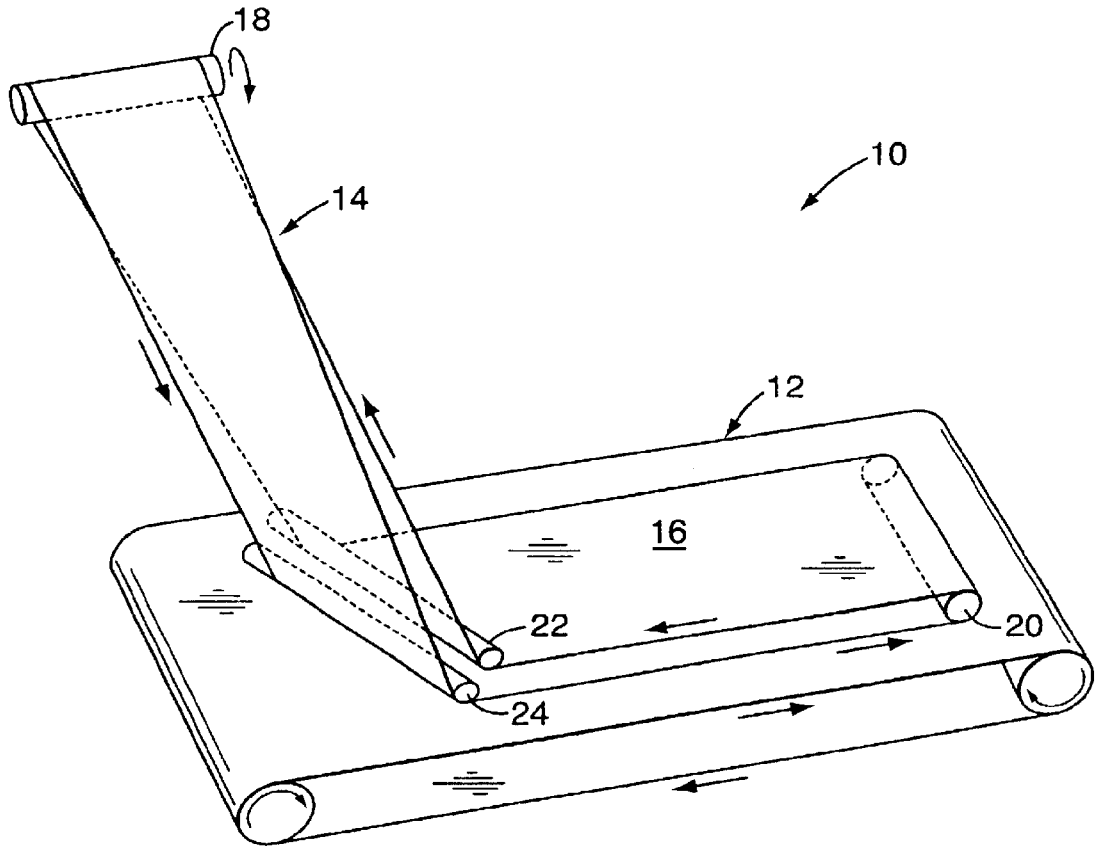
FIGS. 1 and 1*a* are diagrammatic views of the turning conveyor of the present invention, including the course of travel of said turning conveyor.

In reference to FIG. 1, the turning conveyor apparatus 10 of the present invention is comprised of a receiving conveyor 12 and an inversion conveyor 14 having a continuous conveyor belt 16 with a foraminous surface. The foraminous surface of the conveyor belt 16 may be comprised of a durable, flexible, and conformable, synthetic and/or natural sheet material. The conveyor belt 16 may be of homogenous, multi-layered, or of a compound composition comprising additional support layers, whereby the belt 16 construction would be determined by the composition so utilized. The conveyor belt 16 of the present invention may comprise supportive layers, such as a scrim or open mesh, so as to enhance durability. The support layer material can comprise an array of elastomeric plastics, such as polyolefins, polyesters, polyurethane, polyamide, or a combination thereof and take the form of fibrous sheeting, or grid-like netting.

The assembly of the turning conveyor, as illustrated in FIG. 1, further comprises first and second rollers 18 and 20 about which the conveyor belt 16 extends. FIG. 1 is a diagrammatic view of one embodiment of the invention wherein the assembly further comprises a pair of generally parallel, first and second conveyor guides 22 and 24, which may comprise rollers. In this embodiment, the guides 22 and 24 are each cylindrical, and have equal diameters. The guides may be positioned on an angle in order to deflect the material in the desired direction. The conveyor belt 16 of the present invention is configured to effect at least one inversion of a web of material generally along an axis, at guide 24.

The conveyor belt 16 of the invention accepts a material of little or no inherent structural integrity traveling along a first direction. The belt 16 then extends about an axis at guide 24 during the course of travel so as to invert the material deposited there upon. The axis or guide 24 about which the conveyor belt moves may comprise a retentive means in order to control the position of the material, thereby constraining movement of the material. In the event a vacuum source is used as retentive means, the vacuum performs by providing suction through the foraminous surface of the conveyor belt 16, either over the entire course of travel, or only at the pivotal point along guide 24, affixing the material to the conveyor belt 16 during its course of travel, while keeping the integrity of the material intact.

A particular advantageous application of the present invention, the turning conveyor may operate in the production of a composite or laminate nonwoven fabric. In this embodiment, the turning conveyor accepts a low structural integrity fibrous batt, while traveling in a first direction. During the course of the conveyor's travel, it moves about an axis, such as a guide 24. Upon movement and inversion about guide 24, the belt 16 then changes its course of travel, carrying a fibrous batt, for instance, in a second direction, whereby the fibrous batt may be released and deposited onto a second substrate, such as preformed material, or another fibrous batt.

Figure 1A:
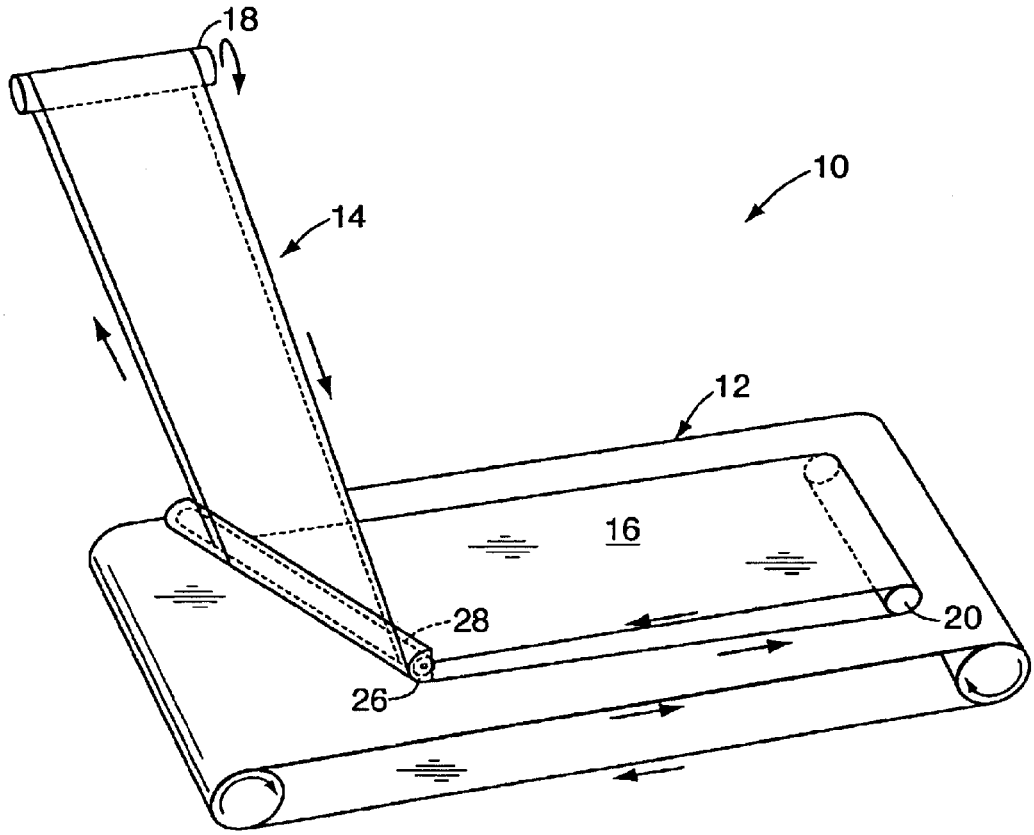

FIG. 1*a* illustrates an alternate embodiment of the present invention, wherein first and second guides 26, 28 define first and second concentric guide surfaces. First guide 26 can be generally semi-cylindrical in configuration, with the second guide, which can be generally cylindrical, mounted generally within the first, outer guide.

Utilizing the turning conveyor of the present invention is beneficial in the production of products, such as nonwoven fabrics, as such a conveyor can potentially limit the number of large, complex, and expensive pieces of equipment such as cards and film extrudes. A single turning conveyor or multiple turning conveyors may be utilized parallel with a production line, or may be utilized within a production line. Elimination of such equipment from the production of multi-layered nonwoven fabric constructs enables production line assets, such as spunbond lines, to feed multiple productions lines, or to create layered or complex constructs from fewer pieces of equipment.

From the foregoing, numerous modifications and variations can be effected without departing from the true spirit and scope of the novel concept of the present invention. It is to be understood that no limitation with respect to the specific embodiment disclosed herein is intended or should be inferred.

What is claimed is:

1. A conveyor apparatus for handling and inverting a web of material, comprising:

a receiving conveyor having an upper run for receiving said web of material after inversion; and an inversion conveyor having first and second legs arranged at an angle to each other, the second leg being positioned above the upper run for said receiving conveyor;

said inversion conveyor comprising a first conveyor roller positioned at one end of said first leg, and second conveyor roller positioned at one end of said second leg, and first and second generally parallel conveyor guides positioned at an angle to each of said first and second rollers at the juncture of said first and second legs of said inversion conveyor;

said inversion conveyor further comprising an inversion conveyor belt which extends:

(1) along an upper run of said first leg from above said first roller to beneath said first conveyor guide;

(2) along a lower run of said second leg from beneath said first conveyor guide to beneath said second roller, above said upper surface of said receiving conveyor;

(3) along an upper run of said second leg from above said second roller to beneath said second guide; and (4) along a lower run of said first leg from beneath said second guide to said first roller;

so that when said web of material is received on said upper run of said first leg of said inversion conveyor the web of material is inverted as the web moves around and beneath the first guide, with the inverted web of material received on the upper run of the receiving conveyor.

2. A turning conveyor belt as set forth in claim 1, wherein said belt is comprised of a foraminous surface.

3. A turning conveyor belt as set forth in claim 1, wherein said belt is comprised of a single or multi-layered composition.

4. A turning conveyor belt as set forth in claim 3, wherein said single or multi-layered belt is comprised of material

5. A conveyor apparatus in accordance with claim 1, wherein:

said first and second conveyor guides comprise a pair of cylindrical guides having equal diameter, arranged in generally parallel relationship.

6. A conveyor apparatus in accordance with claim 1, wherein:

said first and second conveyor guides respectively define first and second concentric guide surfaces, said second guide surface being positioned generally within said first guide surface.

* * * * *

UNITED STATES PATENT AND TRADEMARK OFFICE

CERTIFICATE OF CORRECTION

PATENT NO. : 6,886,681 B2
DATED : May 3, 2005
INVENTOR(S) : Benjamin Nolan and Leonard Streeper It is certified that error appears in the above-identified patent and that said Letters Patent is hereby corrected as shown below:

Title page,
Item [73], Assignee, "Charleston, SC", should be -- North Charleston, SC --.

Column 5,
Line 2, after "material", please insert -- selected from the group of natural or synthetic rubbers or a combination thereof. --.

Signed and Sealed this

Twenty-seventh Day of September, 2005

JON W. DUDAS
*Director of the United States Patent and Trademark Office*